US006766534B2

(12) United States Patent
Lewis et al.

(10) Patent No.: US 6,766,534 B2
(45) **Date of Patent: *Jul. 27, 2004**

(54) PROTECTIVE HOOD, SUCH AS FIREFIGHTER'S HOOD, WHICH HAS SECTIONS MADE FROM COMPARATIVELY HEAVIER AND COMPARATIVELY LIGHTER MATERIALS

(75) Inventors: Patricia Lewis, Huber Heights, OH (US); Mary I. Grilliot, Dayton, OH (US); William L. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/628,529

(22) Filed: Jul. 28, 2003

(65) Prior Publication Data

US 2004/0019957 A1 Feb. 5, 2004

Related U.S. Application Data

(63) Continuation-in-part of application No. 10/136,564, filed on May 1, 2002, now Pat. No. 6,662,375.

(51) Int. Cl.[7] ..... A42B 1/04
(52) U.S. Cl. ..... 2/84
(58) Field of Search ..... 2/5, 7, 8, 9, 84, 2/202, 81, 171, 456–458, 69, 69.5, 468, 459, 461; 128/201.25, 201.29, 207.11

(56) References Cited

U.S. PATENT DOCUMENTS

| | | | | | |
|---|---|---|---|---|---|
| 128,451 | A | * | 7/1872 | Ackerman | 2/10 |
| 751,091 | A | * | 2/1904 | Moran | 128/201.25 |
| 2,709,667 | A | * | 5/1955 | Grubb et al. | 442/1.18 |
| 3,458,864 | A | * | 8/1969 | Austin et al. | 2/5 |
| 4,573,217 | A | | 3/1986 | Reed | |
| 4,972,520 | A | | 11/1990 | Grilliot et al. | |
| 5,090,054 | A | | 2/1992 | Grilliot et al. | |
| 5,109,549 | A | | 5/1992 | Mattinson | |
| 5,628,065 | A | | 5/1997 | Austin | |
| 5,873,132 | A | | 2/1999 | Grilliot et al. | |
| 6,006,360 | A | | 12/1999 | Reed | |
| 6,260,207 | B1 | | 7/2001 | Barbeau et al. | |
| 6,662,375 | B2 | * | 12/2003 | Lewis | 2/202 |

* cited by examiner

*Primary Examiner*—Tejash Patel
(74) *Attorney, Agent, or Firm*—Wood, Phillips, Katz, Clark & Mortimer

(57) ABSTRACT

A protective hood, such as a firefighter's hood, has an upper head-covering section, an anterior head-covering section having a window, through which portions of a wearer's face are exposed, a posterior-head covering section, and a lower shoulder-covering section. The anterior head-covering section is made from comparatively heavier, thermally insulative, heat-reflective material, whereas the upper head-covering section and the other sections, or a selected one of the other sections, are made from similar, comparatively lighter material, such as mesh or netting, whereby to allow heat to pass readily through those sections made from comparatively lighter material.

10 Claims, 1 Drawing Sheet

PROTECTIVE HOOD, SUCH AS FIREFIGHTER'S HOOD, WHICH HAS SECTIONS MADE FROM COMPARATIVELY HEAVIER AND COMPARATIVELY LIGHTER MATERIALS

CROSS-REFERENCE TO RELATED APPLICATION

This application is a continuation-in-part of U.S. patent application Ser. No. 10/136,564, which was filed on May 1, 2002, now U.S. Pat. No. 6,662,375 and the disclosure of which is incorporated herein by reference.

TECHNICAL FIELD OF THE INVENTION

This invention pertains to a protective hood, such as a firefighter's hood, of as type worn, ordinarily, with a protective helmet, which may have a depending shroud to protect side and rear portions of a wearer's head, and with a protective coat.

BACKGROUND OF THE INVENTION

Protective hoods of the type noted above are exemplified in U.S. Pat. No. 4,972,520, U.S. Pat. No. 5,090,054, and U.S. Pat. No. 5,873,132, the disclosures of which are incorporated herein by reference, and are available commercially from Morning Pride Manufacturing, L.L.C. of Dayton, Ohio.

As exemplified in those patents, protective hoods have respective head-covering and shoulder-covering portions made from similar, comparatively heavier, thermally insulative material, except that upper head-covering portions are made from comparatively lighter material, such as mesh or netting, which allows thermal energy to pass readily.

Protective hoods of related interest are exemplified in U.S. Pat. No. 4,573,217 and in U.S. Pat. No. 5,628,065.

Protective hoods of the type noted above are worn not only by firefighters but also by rescue workers, race car drivers, and others.

SUMMARY OF THE INVENTION

This invention provides a protective hood of the type noted above, with comparatively lighter material(s) being used not only at an upper head-covering section, as mentioned above, but also elsewhere where comparatively heavier, thermally insulative material(s) may not be always needed.

Generally, as provided by this invention, a protective hood has an upper head-covering section, which when the protective hood is worn covers an upper portion of a wearer's head, an anterior head-covering section, which when the protective hood is worn covers an anterior portion of the wearer's head, the anterior head-covering section having a window, through which portions of the wearer's face are exposed when the protective hood is worn, a posterior head-covering section, which when the protective hood is worn covers a posterior portion of the wearer's head, and a lower shoulder-covering portion, which when the protective hood is worn covers portions of the wearer's shoulders.

Broadly, this invention contemplates that the anterior head-covering section is made from comparatively heavier, thermally insulative material, that the upper head-covering section is made from comparatively lighter material, and that at least one of the other sections is made from comparatively lighter material, whereby to allow thermal energy to pass readily through those sections made from comparatively lighter material. The upper head-covering section, the posterior head-covering section, and the lower shoulder-covering section may be thus made from comparatively lighter material, which may be similar material, such as similar mesh or netting material.

This invention contemplates that, in certain embodiments, the anterior head-covering section is heat-reflective. Preferably, in those embodiments, the anterior head-covering section is aluminized so as to be heat-reflective.

DETAILED DESCRIPTION OF THE ILLUSTRATED EMBODIMENTS

Figure 1:
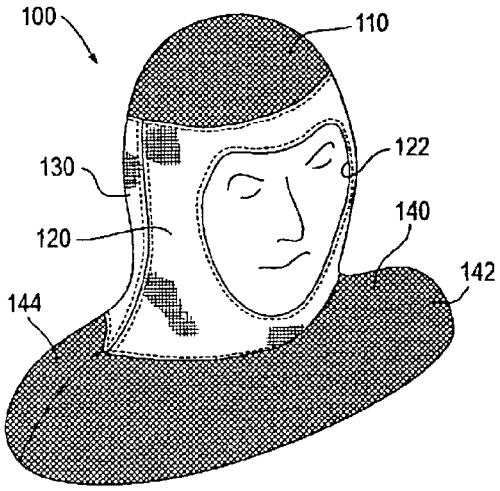
FIG. 1 is a perspective view of a protective hood constituting a first embodiment of this invention, as worn by a wearer whose face appears.
Figure 2:
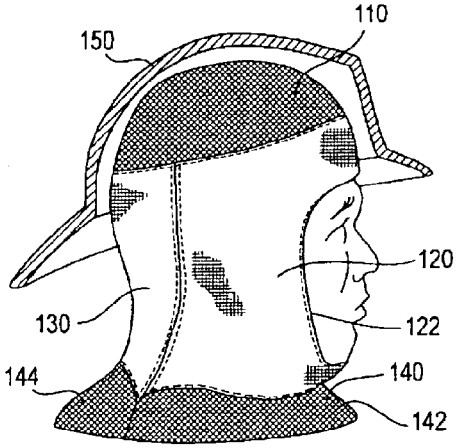
FIG. 2 is a side elevation of the protective hood of FIG. 1, as worn by the same wearer with a protective helmet appearing in cross-section. The protective helmet appearing in FIG. 2 does not have a depending shroud.

As illustrated in FIGS. 1 and 2, a protective hood 100 constituting a first embodiment of this invention has an upper head-covering section 110, an anterior head-covering section 120 having a window 122, through which portions of a wearer's face are exposed when the protective hood 100 is worn, a posterior head-covering section 130, and a lower shoulder-covering section 140 made in two subsections sewn together, namely, an anterior subsection 142 and a posterior subsection 144. The respective sections 110, 120, 130, 140, are sewn together.

Ordinarily, the protective hood 100 is worn with a protective coat (not illustrated) of a type that includes plural layers including a thermally insulative layer and that covers both subsections 142, 144, of the lower shoulder-covering section 140, whereby to provide thermal protection for the wearer's shoulders. As illustrated in FIG. 2, the protective hood 100 is worn with a protective helmet 150, which does not have a depending shroud. Because the protective helmet 150 provides thermal protection for upper portions of the wearer's head, it is not needed for the protective hood 100 to provide thermal protection for those portions of the wearer's head.

Whereas the anterior head-covering section 120 and the posterior head-covering section 140 are made from similar, comparatively heavier, thermally insulative material, the upper head-covering section 110 and both subsections 142, 144, of the lower-shoulder covering section 140 are made from similar, comparatively lighter material, such as similar mesh or netting material, whereby to allow thermal energy to pass readily through those sections made from comparatively lighter material.

Figure 3:
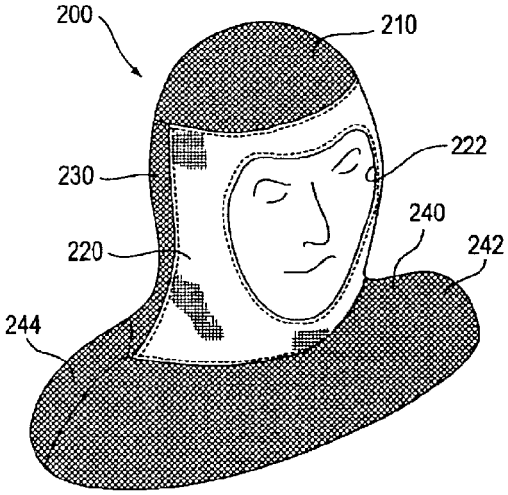
FIG. 3 is a perspective view of a protective hood constituting a second embodiment of this invention, as worn by a wearer whose face appears.
Figure 4:
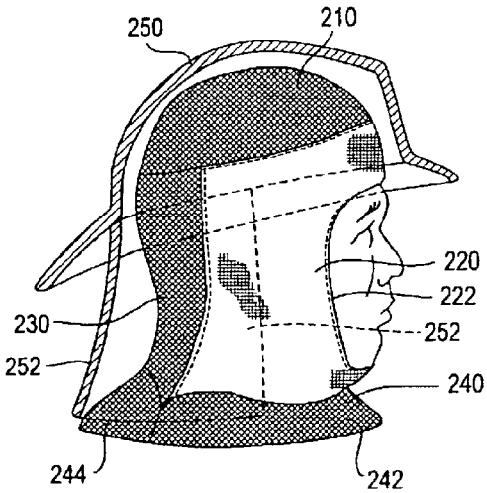
FIG. 4 is a side elevation of the protective hood of FIG. 3, as worn by the same wearer with a protective helmet appearing in cross-section. The protective helmet appearing in FIG. 3 has a depending shroud.

As illustrated in FIGS. 3 and 4, a protective hood 200 constituting a second embodiment of this invention has an upper head-covering section 210, an anterior head-covering section 220 having a window 222, through which portions of a wearer's face are exposed when the protective hood 200 is worn, a posterior head-covering section 230, and a lower shoulder-covering section 240 made in two subsections sewn together, namely, an anterior subsection 242 and a posterior subsection 244. The respective sections 210, 220, 230, 240, are sewn together.

Ordinarily, the protective hood 200 is worn with a protective coat (not illustrated) of a type that includes plural layers including a thermally insulative layer and that covers both subsections 240, 242, of the lower shoulder-covering section 240, whereby to provide thermal protection for the wearer's shoulders. As illustrated in FIG. 4, the protective hood 200 is worn with a protective helmet 250, which has a depending shroud 252. The protective helmet 250 provides thermal protection for upper portions of the wearer's head. The depending shroud 252 provides thermal protection for side and rear portions of the wearer's head. Because the protective helmet 150 provides thermal protection for upper portions of the wearer's head and because the depending shroud 152 provides thermal protection for side and rear portions of the wearer's head, it is not needed for the protective hood 100 to provide thermal protection for those portions of the wearer's head.

Whereas the anterior head-covering section 220 is made from similar, comparatively heavier, thermally insulative material, the upper head-covering section 210, the posterior head-covering section 230, and both subsections 242, 244, of the lower-shoulder covering section 240 are made from similar, comparatively lighter material, such as similar mesh or netting material, whereby to allow thermal energy to pass readily through those sections made from comparatively lighter material.

Because the protective hoods 100, 200, use comparatively lighter materials where comparatively heavier, thermally insulative materials are not needed, the protective hoods 100, 200, are expected to be more comfortable to wear, as compared to prior protective hoods of the type noted above.

In certain embodiments contemplated by this invention, the anterior head-covering section 120, 220, of the protective hood 100, 200, is heat-reflective. Preferably, in those embodiments, the anterior head-covering section 120, 220, is aluminized so as to be heat-reflective. Preferably, in those embodiments, the other sections of the protective hood 100, 200, are not heat-reflective.

What is claimed is:

1. A protective hood having an upper head-covering section, which when the protective hood is worn covers an upper portion of a wearer's head, an anterior head-covering section, which when the protective hood is worn covers an anterior portion of the wearer's head, the anterior head-covering section having a window, through which portions of the wearer's face are exposed when the protective hood is worn, a posterior head-covering section, which when the protective hood is worn covers a posterior portion of the wearer's head, and a lower shoulder-covering section, which when the protective hood is worn covers portions of the wearer's shoulders, wherein the anterior head-covering section is made from comparatively heavier, thermally insulative, heat-reflective material, wherein the upper head-covering section is made from comparatively lighter material, and wherein at least one of the other sections is made from comparatively lighter material, whereby to allow heat to pass readily through those sections made from comparatively lighter material.

2. The protective hood of claim 1 wherein the upper head-covering section and at least one of the other sections are made from similar material.

3. The protective hood of claim 1 wherein the upper head-covering section and the posterior head-covering section are made from similar material.

4. The protective hood of claim 1 wherein the upper head-covering section and the lower shoulder-covering section are made from similar material.

5. The protective hood of claim 1 wherein the upper head-covering section, the posterior head-covering section, and the lower shoulder-covering section are made from similar material.

6. The protective hood of claim 1 wherein the upper head-covering section and at least one of the other sections are made from similar mesh or netting material.

7. The protective hood of claim 1 wherein the upper head-covering section and the posterior head-covering section are made from similar mesh or netting material.

8. The protective hood of claim 1 wherein the upper head-covering section and the lower shoulder-covering section are made from similar mesh or netting material.

9. The protective hood of claim 2 wherein the upper head-covering section, the posterior head-covering section, and the lower shoulder-covering section are made from similar mesh or netting material.

10. The protective hood of any one of claims 1 through 9 wherein the anterior head-covering section is aluminized so as to be heat-reflective.

* * * * *